United States Patent [19]

Rosa

[11] 4,388,897

[45] Jun. 21, 1983

[54] VARIABLE CAMSHAFT ASSEMBLY

[76] Inventor: Bernard Rosa, 11 Waverly Pl., New York, N.Y. 10003

[21] Appl. No.: 189,108

[22] Filed: Sep. 22, 1980

[51] Int. Cl.[3] ..... F01L 1/34

[52] U.S. Cl. ..... 123/90.17; 123/90.6

[58] Field of Search ..... 123/90.15, 90.17, 90.18, 123/90.6

[56] References Cited

U.S. PATENT DOCUMENTS

| | | | |
|---|---|---|---|
| 1,061,098 | 5/1913 | McKeen, Jr. | 123/90.15 |
| 2,191,459 | 2/1940 | Duncan | 123/90.17 |
| 2,804,061 | 8/1957 | Gamble | 123/90.18 |
| 2,851,023 | 9/1958 | Durkan | 123/90.16 |
| 2,888,837 | 6/1959 | Hellmann | 123/90.17 |
| 2,980,089 | 4/1961 | Sampietro | 123/90.18 |
| 3,261,338 | 7/1966 | Arutunoff et al. | 123/90.16 |
| 3,413,965 | 12/1968 | Gavasso | 123/90.16 |
| 3,481,314 | 12/1969 | LeCrenn | 123/90.18 |
| 3,618,574 | 11/1971 | Miller | 123/90.18 |
| 3,641,988 | 2/1972 | Torazza et al. | 123/90.16 |

FOREIGN PATENT DOCUMENTS

| | | | |
|---|---|---|---|
| 388956 | 1/1924 | Fed. Rep. of Germany | 123/90.18 |
| 478967 | 7/1929 | Fed. Rep. of Germany | 123/90.18 |
| 1109790 | 2/1956 | France | 123/90.18 |
| 322504 | 2/1972 | U.S.S.R. | 123/90.18 |

*Primary Examiner*—Craig R. Feinberg
*Assistant Examiner*—W. R. Wolfe

[57] ABSTRACT

A variable camshaft assembly which serves to vary the timing of poppet valves in an internal combustion engine. An axially movable wormed camshaft controls a number of splitable cams of conventional cross section operating individual valves. When the camshaft is shifted axially, each valve operating cam splits into two operating elements. When the raised noses of the splitable cam elements are in alignment, the valve event is minimal. When the raised noses are in misalignment, the valve event is extended.

5 Claims, 7 Drawing Figures

1
2
3
4
5
6
7
8
9
10
11
12

VARIABLE CAMSHAFT ASSEMBLY

BACKGROUND OF THE INVENTION

This invention relates generally to valve trains and more specifically to camshafts as a means to control and vary the timing of poppet valves in internal combustion engines.

Present day internal combustion engines suffer from one very obvious technical defect—the faster the engine turns, the shorter the time the valves remain open, since the camshaft and crankshaft make complete revolutions in a fixed relationship. Obviously, for more efficient engine operation, the reverse would be preferable—valves that remain open at higher speeds (relative to a complete engine revolution), both to ingest the greater volume of fuel-air mixture and to expel the greater density of exhaust gases, while a shorter valve event at lower speeds would serve to curtail power loss and to lessen the emission of unburned hydrocarbons, both of these adverse effects being a result of valves left open overlong. In practice, valve settings are always a compromise—being efficient in some middle range but losing efficiency markedly in the high and low speed ranges.

Prior art discloses many attempts to produce a practical variable valve timing device with which to overcome the described problem, none of which solutions can be deemed successful since it can be shown that modern day valve trains are not variable in operation, and are in fact basically unchanged in operating mode from valve trains of a half century ago, showing only an increased tendency towards overhead arrangements—first as to valves, and more recently as to camshafts.

The reasons for the commercial failure of previously patented variable timing devices are many—overcomplexity, high cost of manufacture, space or weight considerations, but most especially the lack of indicated durability. A common thread in these prior art devices is their heavy reliance on unproven non-standard valve train elements, elements such as fulcrums, frusticonical cams, oscillating cams and wedges, subsidiary camshafts, concentric wheels, hydraulics, belt tensioners, and the like. Furthermore, almost all these prior devices rely on either point contact design or on double cycle components. In point contact designs, somewhere along the valve train, all the considerable pressures of valve train operation are concentrated on a single pin point of contact, resulting inevitably in wear and control problems, while devices which seek to avoid this weakness are usually double cycle in nature—that is, they operate and reverse direction two or more times per camshaft revolution, this also being an unpromising situation in terms of indicated durability.

Avoiding this approach, the present invention draws directly on proven marketplace valve train design, utilizing basically equivilant components in basically equivilant working relationships, reconfiguring such components and relationships only in the minimal amount neccesary to arrive at the intent of this invention—a simple and durable means of making variable the valve event in an internal combustion engine.

The object of the present invention is to provide an improved valve operating mechanism for an internal combustion engine which serves to vary the valve events.

Another object of the invention is to provide an improved camshaft, wormed for a portion of its length, to assist in variably controlling the valve event in an internal combustion engine.

Another object of the invention is to provide a variable cam assembly, said cam assembly splitable into two or more operating parts, said cam assembly to assist in variably controlling the valve event in an internal combustion engine.

Another object of the invention is to provide an efficient means for axially shifting a camshaft.

Another object of the invention is to provide speed sensitive means for variably controlling the valve event in an internal combustion engine.

Another object of the invention is to provide a method whereby a controllable power source may variably alter the valve event in an internal combustion engine, such controllable power source programable to such considerations as engine speed, engine or ambient temperature, engine load, acceleration, decelleration, braking, and exhaust emissions.

Another object of the invention is to increase engine efficiency by the use of paired variable camshafts according to the invention, one such variable camshaft working intake valves only, the second such variable camshaft working exhaust valves only, such paired variable camshafts capable of operating independently or in synchronization.

Other and further objects of the invention will become apparent to those skilled in this art from the following description of the annexed sheets of drawings which by way of preferred example only, illustrate several embodiments of the present invention.

DESCRIPTION OF THE PREFERRED EMBODIMENTS

Figures 1, 2:
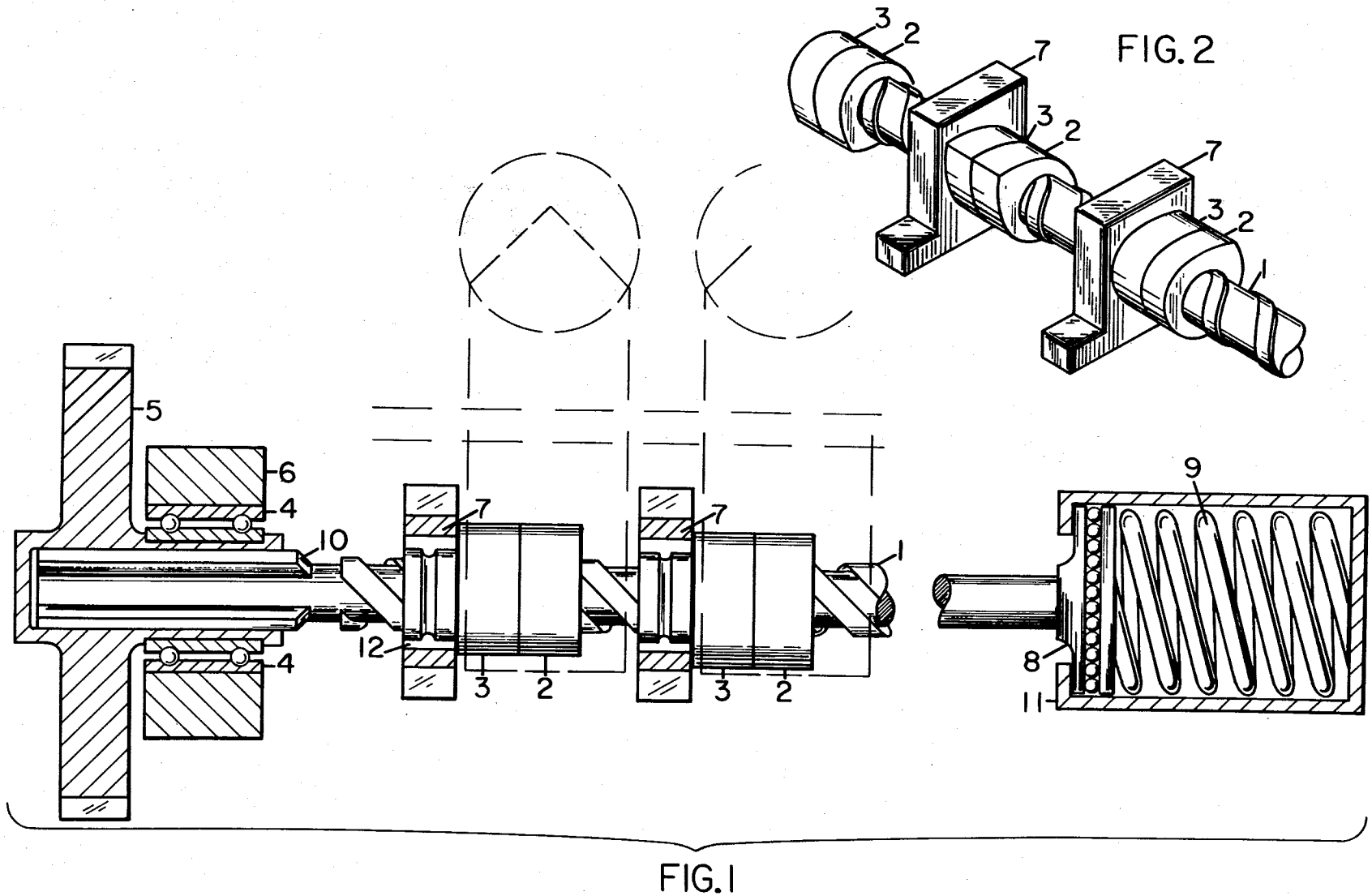
FIG. 1 is a top sectional view of a portion of the camshaft assembly according to the principles of this invention, illustrating the axial position of the camshaft assembly at rest or at idling speed.
FIG. 2 is a three quarter view of a portion of the camshaft assembly in the same speed mode as in FIG. 1, showing the alignment of the noses on the splitable cam.

FIG. 1 illustrates in a fragmentary manner an axially movable wormed camshaft 1, rotatably mounted on fixed camshaft supports 7, and driven by a timing gear 5, which gear has a splined opening at one end to receive slidably the splines 10 at one end of the camshaft 1. The base of the camshaft support 7 is affixed to the engine body while the timing gear 5 is rotatably supported by the timing gear support 6, through the medium of bearings 4. The timing gear support 6 is also affixed to the engine body. The engine, by means of linkage, turns the timing gear 5, which by the mating of its splined opening with the splines 10 on the end of the camshaft 1, thusly imparts a rotational movement to the camshaft 1.

Figure 5:
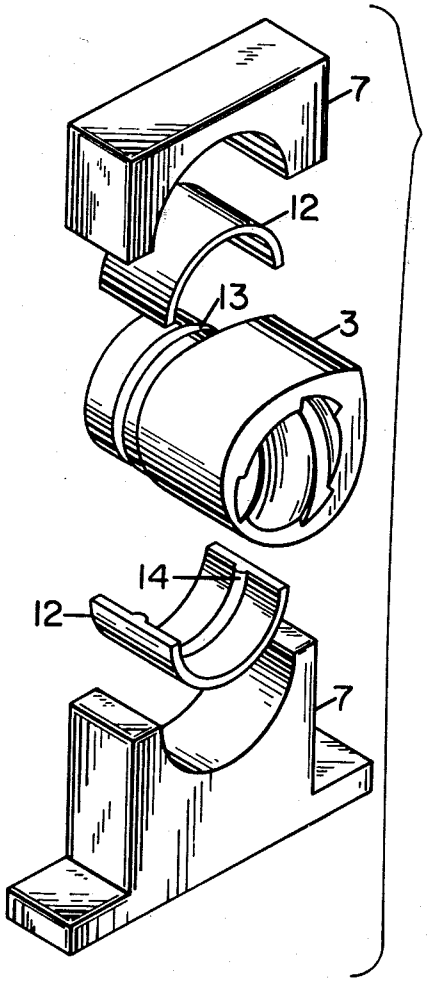
FIG. 5 is an exploded three quarter view showing in detail the method whereby the secondary cam is carried by, and trapped within the camshaft support.

On the wormed camshaft 1 is a series of cam assemblies, each such cam assembly splitable into two cam elements, the primary cam 2, and the secondary cam 3, both cam elements operating on a single valve. The primary cam 2 is affixed to (or integral with) the camshaft 1, while the secondary cam 3 is rotatably mounted (FIG. 5) on the camshaft support 7 by means of sleeve bearings 12 and is held axially within the camshaft support 7 by a raised bead 13, said raised bead 13 drawn about a circular portion of the secondary cam 3. The raised bead 13 fits within a corresponding groove 14 set into sleeve bearings 12. Thus, the secondary cam 3 is trapped by, and rotatable within the sleeve bearings 12, said sleeve bearings 12 set fixedly within the camshaft support 7.

The wormed camshaft 1 fits precisely within and through a corresponding wormed opening through the center of the secondary cam 3, and is spirally movable within, with the aforementioned circular portion of the secondary cam 3 thus acting as a rotatable support for the camshaft 1. The oblique angle of the raised worming on the camshaft 1 acts as a diagonal spline on the corresponding worming through the opening of the secondary cam 3, and since the secondary cam 3 can only move rotatably about the sleeve bearings 12 locked onto the camshaft support 7, the secondary cam 3 must rotate in place in time with the rotation of the camshaft 1.

In the low speed mode (FIG. 1), the camshaft 1 is held fully seated within the splined opening of the timing gear 5 by means of the camshaft return spring 9, through the intercession of a roller bearing 8. The camshaft return spring 9 is held within a housing 11, said housing 11 affixed to the engine body. In this mode, the primary cam 2 sits directly next to the secondary cam 3 with the high points of both cam noses aligned, as in FIG. 2. Thus, at low speed (or idle), the cam nose engagement with the cam follower of the valve operating assembly is of minimal duration.

Figures 3, 4:
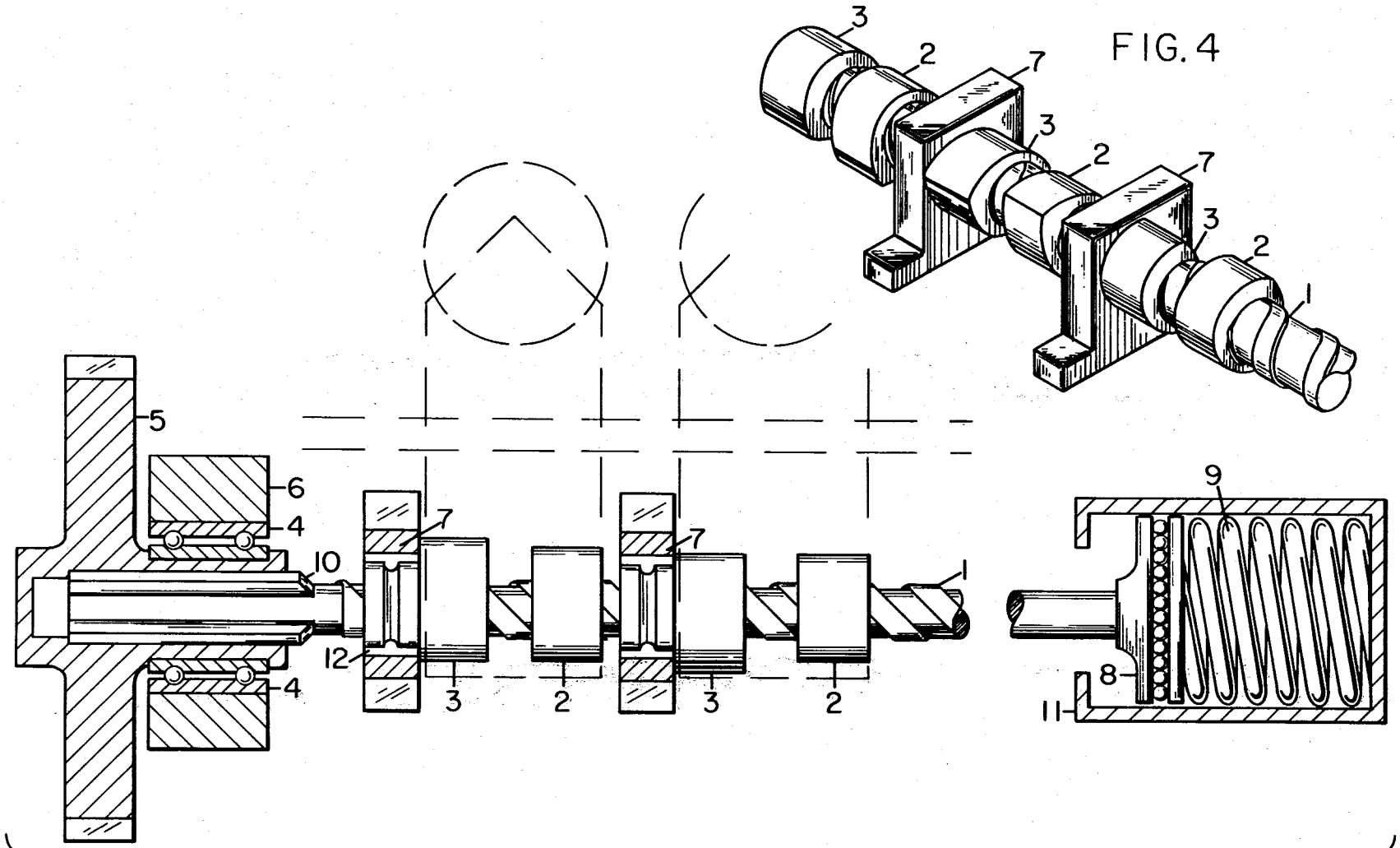
FIG. 3 is a top sectional view of a portion of the camshaft assembly essentially similar to the view in FIG. 1, illustrating the axial position of the camshaft assembly in a high speed mode.
FIG. 4 is a three quarter view of a portion of the camshaft assembly in the same speed mode as in FIG. 3, illustrating the misalignment of the splitable cam noses.

In the high speed mode, as shown in FIG. 3, centrifugal force comes into play. The combination of camshaft speed, direction of camshaft worming, direction of camshaft rotation, and camshaft weight, reacts against the drag induced by the trapped secondary cam 3, and urges the camshaft 1 axially away from, and partly out of, the splined opening in the timing gear 5, in the process compressing the camshaft return spring 9. The camshaft return spring 9 is designed to exactly offset such induced centrifugal force as a function of engine speed, being at maximum extension at rest, idle, or very low speed, compressing progressively as engine speed increases, becoming fully compressed at generally maximum speed.

Figure 7:
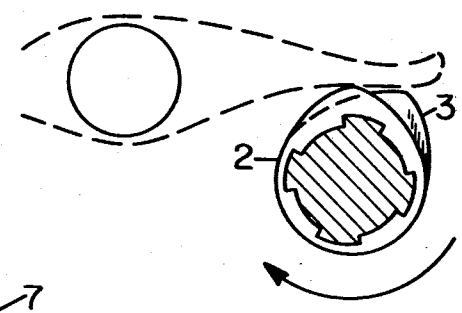
FIG. 7 is a view in cross section of the variable camshaft assembly according to the principles of this invention, illustrating the manner in which the misaligned cam noses serve to delay the valve event in a high speed mode.
Figure 6:
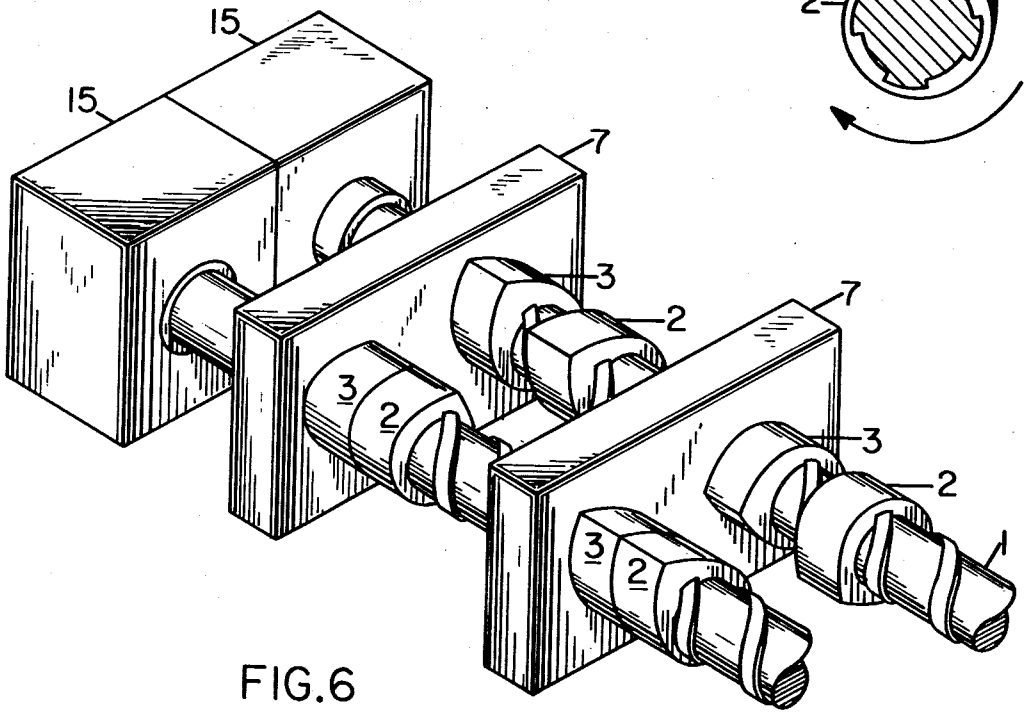
FIG. 6 is a three quarter view illustrating a paired variable camshaft arrangement and a controllable power source as a means of axially shifting said paired variable camshafts. The two variable camshaft assemblies are shown in different operating modes.

As the camshaft 1 shifts axially, the primary cam 2, which is solidly affixed to (or integral with) the camshaft 1, shifts axially along with the camshaft 1, thus moving apart from the secondary cam 3, which is trapped rotatably in place by the fixed camshaft support 7. Because of the positive engagement of the raised worming on the camshaft 1 with the corresponding worming of the opening through the center of the secondary cam 3, the axial shifting of the camshaft 1 imparts a slightly retrograde movement rotatably to the secondary cam 3, thereby moving the secondary cam nose out of alignment with the primary cam nose, as shown in FIG. 4. Since both the primary cam 2 and the secondary cam 3 operate collectively on each individual valve, the misaligned cam noses serve to hold the said individual valve open for a longer period of time relative to a complete engine revolution, as illustrated in FIG. 7.

While not shown as a part of this invention, it is understood that the cam follower, of whichever design, must be of sufficient width to accomodate the axial shift of the primary cam 2 while continuing to accomodate the axially stationary secondary cam 3. A cam follower of sufficient width is indicated by broken lines encompassing the entire splitable cam assembly in FIG. 1 and FIG. 3, the cam follower in this particular embodiment being an element of a rocker arm assembly. It should be noted that the primary cam 2, which is pinned to or integral with the camshaft 1, is functionally as rigid as in any conventional cam-camshaft design and that it is the primary cam nose which (through the valve operating mechanism) accepts the load of each valve opening, the less rigid secondary cam nose engaging, and extending the moment of, an already depressed valve.

Thus, the faster the engine speed, the greater the axial shift of the camshaft 1 away from the timing gear 5, the greater the misalignment of the primary and secondary cam noses (up to a maximum misalignment of approximately 45 degrees circular), and the longer the valve event relative to a complete engine revolution. Conversely, the slower the engine speed, the shorter the valve event relative to a complete engine revolution, with a stepped progression of valve moments in between, such a condition fulfilling the intent of this invention.

In another embodiment of this invention, the camshaft return spring 9 and the camshaft return spring housing 11 are deleted and replaced by other means, such means comprising any suitable controlled power source 15, such means 15 affixed to the engine body and rotatably coupled to an end of the camshaft 1 through the medium of a roller bearing 8. By a pushing or pulling action, the controlled power source means 15 forcibly shifts the camshaft 1 axially, said axial shift working with or against, but generally irrespective of, the said centrifugal forces generated within the invention, said axial shifting of the camshaft 1 controlling the valve timing. Said controllable power source means 15 would thus enable, through suitable linkage and preprogramming, the valve timing to be varied as a function of such diverse factors as engine speed, engine and ambient temperature, engine load, acceleration, decelleration, braking, emissions control, and other relevant factors.

Another embodiment of the invention employs twin variable camshafts as described in the invention, one such variable camshaft used to operate the intake valves only in a given engine, the second such variable camshaft used to operate the exhaust valves only in the same engine, such twin variable camshafts capable of operating independently or in synchronization according to a program controlling the power source means 15.

While the above description contains many specifities, these should not be construed as limitations on the scope of the invention, but rather as preferred embodiments thereof. Other variations are possible. For instance;

A twin variable camshaft arrangement as described above but with individual camshaft return springs 9 in place of the controlled power source means. In one embodiment, said individual camshaft return springs 9 are of matched compression strength while in another embodiment the individual camshaft return springs 9 are of slightly different compression strengths, thereby allowing the intake valves to operate in a slightly different cycle from the exhaust valves, such difference according to efficiency considerations and the intended use of the engine.

Further, although the preferred embodiment shown in the drawings depicts the variable camshaft comprising this invention in an overhead position and acting on a valve train employing rocker arms, it should be understood that the invention may be situated in any conventional camshaft location, and may work on any conventional valve operating mechanism, provided only that the said valve operating mechanism incorporate a cam follower of sufficient width to accomodate the maximum displacement between the primary cam 2 and the secondary cam 3 in the high speed mode. Note also that the method shown for rotatably securing the the secondary cam 2 to the camshaft support 7 by means of a bead 13 and groove 14 is similarly a preferred embodiment and that many other simple and obvious means exist for acheiving a like result.

Also, let it be noted that the word 'wormed', as applied to the camshaft of this invention, includes such obvious reconfigurations as threading, beading, or other spiral shaping of the camshaft of the invention in order to acheive the same result.

I claim as my invention:

1. In an internal combustion engine employing a two part cam assembly to vary valve timing, including speed sensitive means, a double function cam-camshaft-camshaft support arrangement comprising, an axially movable camshaft acting against a camshaft return spring through the intercession of a rotatable bearing, said camshaft having a plurality of fixed cam surfaces thereon, a wormed portion alongside each fixed cam surface on said camshaft, a camshaft support positioned at or near each said wormed portion of said camshaft, a circular opening through each camshaft support of a diameter larger than that of said camshaft, independent secondary cams of substantially the same outer dimensions of said fixed cam surfaces on said camshaft, each said secondary cam possessing a circular protrusion axially alongside of such diameter and width to mate with and turn rotatably in said circular opening through said camshaft support, means to prevent axial movement of said secondary cam, a centrally positioned wormed opening through said secondary cam and associated circular protrusion of such size and configuration to mesh operably with said wormed portions on said camshaft, such a combination allowing said camshaft a certain amount of twisting axial movement, said twisting axial movement being induced by the combination of weight, rotational speed, and worming of said camshaft acting against the rotatably trapped secondary cams and said camshaft return spring, thereby permitting said cam-camshaft-camshaft support arrangement to vary valve timing while simultaneously acting operably as part of the speed sensing means.

2. In an internal combustion engine employing a split cam assembly to vary valve timing, a cam-camshaft-camshaft support combination neccesitating but two moving parts to functionally operate said split cam assembly, such combination comprising, an axially movable camshaft with fixed cam surfaces thereon, a wormed portion alongside each said fixed cam surface on said camshaft, a camshaft support positioned at each said wormed portion of said camshaft, a circular opening running through each said camshaft support of a diameter larger than that of said camshaft, independent secondary cams of substantially the same outer dimensions of said fixed cam surfaces on said camshaft, each said secondary cam possessing a circular protrusion axially alongside of such diameter and width to mate with and turn rotatably in said circular opening in said camshaft support, means to prevent axial movement of said secondary cam, a centrally positioned wormed opening through said secondary cam and associated circular protrusion of such size and configuration as to mesh operably with said wormed portion on said camshaft, said camshaft and said secondary cam being the only movable elements of such combination.

3. In an internal combustion engine employing a split cam assembly to vary valve timing, including speed sensitive means, a new cam-camshaft-camshaft support combination neccesitating but four moving parts to functionally operate said split cam assembly and said speed sensitive means, such combination comprising, an axially movable camshaft acting against a camshaft return spring through the intercession of a rotatable bearing, said camshaft having a plurality of fixed cam surfaces thereon, a wormed portion alongside each fixed cam surface on said camshaft, a camshaft support positioned at or near each said wormed portion of said camshaft, a circular opening through each camshaft support of a diameter larger than that of said camshaft, independent secondary cams of substantially the same outer dimensions of said fixed cam surfaces on said camshaft, each said secondary cam possessing a circular protrusion axially alongside of such diameter and width to mate with and turn rotatably in said circular opening through said camshaft support, means to prevent axial movement of said secondary cam, a centrally positioned wormed opening through said secondary cam and associated protrusion of such size and configuration to mesh operably with said wormed portions on said camshaft, said camshaft, said secondary cam, said camshaft return spring, and said rotatable bearing being the only movable elements of said split cam assembly and said speed sensitive means.

4. In an internal combustion engine employing a split cam assembly to vary valve timing, a cam-camshaft-camshaft support combination comprising, an axially movable camshaft with fixed cam surfaces thereon, a wormed portion alongside each fixed cam surface on said camshaft, a camshaft support positioned at each said wormed portion of said camshaft, a circular opening cross sectionally through each said camshaft support of a diameter larger than that of said camshaft, independent secondary cams of substantially the same outer dimensions of said fixed cam surfaces on said camshaft, each said secondary cam possessing a circular protrusion axially alongside of such diameter and width to mate with and turn rotatably in said circular opening in said camshaft support, means to prevent axial movement of said secondary cam, a centrally positioned wormed opening through said secondary cam and associated circular protrusion of such size and configuration as to mesh operably with said wormed portion on said camshaft, speed sensitive means for axially shifting said camshaft, such combination allowing the use of a single solid axially movable camshaft to operate said split cam assembly.

5. The combination in claim 4 wherein the speed sensing means comprises, a rotatable bearing set between the potential axial movement of said camshaft and the potential force of a caged compressed spring.

* * * * *